US006164211A

United States Patent [19]

Faris

[11] Patent Number: 6,164,211

[45] Date of Patent: Dec. 26, 2000

[54] CONVERTIBLE TABLE

[76] Inventor: Joseph E. Faris, 15005 Concord Cir., Morgan Hill, Calif. 95037

[21] Appl. No.: 09/352,662

[22] Filed: Jul. 8, 1999

[51] Int. Cl.[7] ..... A47B 65/00

[52] U.S. Cl. ..... 108/11; 108/13

[58] Field of Search ..... 108/11, 13, 14, 108/15, 115, 77; 312/240, 240.1

[56] References Cited

U.S. PATENT DOCUMENTS

| | | | |
|---|---|---|---|
| 358,486 | 3/1887 | Seibert . | |
| 515,955 | 3/1894 | Ettinger . | |
| 696,462 | 4/1902 | Markstrom | 108/13 X |
| 820,732 | 5/1906 | Polster . | |
| 1,038,974 | 9/1912 | Schulz . | |
| 1,348,262 | 8/1920 | Brockway . | |
| 1,929,551 | 10/1933 | Hamilton | 108/13 X |
| 1,930,925 | 10/1933 | Dillon | 108/11 X |
| 2,100,247 | 11/1937 | Groves | 108/13 |
| 2,302,243 | 11/1942 | Mitzel . | |
| 2,566,954 | 9/1951 | Murray . | |
| 2,604,373 | 7/1952 | Beriou et al. | 108/13 X |
| 2,614,611 | 10/1952 | Robertson | 108/13 |
| 3,181,920 | 5/1965 | Burr | 108/11 |
| 3,211,506 | 10/1965 | Levy et al. . | |
| 3,353,885 | 11/1967 | Hanson . | |
| 4,242,967 | 1/1981 | Leonhart . | |
| 4,282,817 | 8/1981 | Gutterman . | |
| 4,446,796 | 5/1984 | Wilson et al. | 108/77 X |
| 4,572,081 | 2/1986 | Copeland . | |
| 5,562,050 | 10/1996 | Colguhoun . | |

*Primary Examiner*—Jose V. Chen
*Attorney, Agent, or Firm*—Thomas Schneck

[57] ABSTRACT

A convertible article of furniture with a movable top and a fixed base. The top has folding panels or leaves and the entire top is movable from a horizontal position, in which the furniture article serves as a table, to a vertical position, in which the furniture article can serve a variety of purposes such as an entertainment center, a wine rack, a computer stand, etc., depending on the position of the folding panels. Drawers and organizers can optionally be inserted into the base.

4 Claims, 3 Drawing Sheets

CONVERTIBLE TABLE

TECHNICAL FIELD

This invention relates to convertible furniture and, more particularly to multi-function convertible tables.

BACKGROUND ART

The size of average living quarters can be small in urban areas these days. Building smaller or collapsible furniture is only one part of the solution; designing furniture articles which serve multiple functions is a more effective way to utilize precious living space in homes.

Large tables, while necessary for special occasions such as dinner parties, pose a particular problem for residents of smaller-sized living quarters. The space taken up by a large table which can seat eight should be better utilized when the table is not in use.

In U.S. Pat. No. 5,562,050, Colquhoun teaches a collapsible table and bookshelf in which the sides of the table can be folded only after the hinges and the top rails are removed. In U.S. Pat. No. 4,282,817, Gutterman teaches an expandable furniture which requires sliding out of concealed support bracket when the table is being expanded. In U.S. Pat. No. 3,353,885, Hanson teaches an expansible multi-purpose cabinet which requires manual lifting when the cabinet is expanded.

A primary object of this invention is to provide a spacious table which can be converted from a table with large top surface into a furniture article that assumes a small footprint and serves other purposes. In this application "footprint" means the effective floor space used by an article of furniture. In the case of a table, the "footprint" includes the "shadow" cast by an overhead lamp on the table top and onto the floor space below.

Another object of the present invention is to provide an article of furniture having space saving characteristics, including ease of conversion from one use to another without any reassembly of the parts.

Still another object of this invention is to build a piece of aesthetically-pleasing furniture with the same visual appeal as its non-convertible counterpart.

Yet another object of the invention is to build a piece of furniture of great durability and with a freedom in the choice of manufacturing materials so as to ensure that the invention can be manufactured economically with various durable materials.

SUMMARY OF INVENTION

The above objects have been achieved in a convertible article of furniture having a movable top in relation to a fixed base, with the top serving dual functions. The top has overall dimensions of a table top, and is related to the base in two configurations: a vertical or display configuration wherein the top is standing behind the base, and a horizontal or table configuration wherein the top is parallel to the top of the base and is directly supported by the base. The top is movably joined to the base and can be moved from the horizontal position to the vertical position by a simple pivot action. The base is rectangular in shape and has an interior volume that can accommodate different inserts and be adapted for different purposes.

While large-surfaced tables serve many useful functions, storing them when they are not in use poses a problem. The present invention meets the objective of providing a large table that not only can be arranged to assume a smaller footprint, but can also serve a multiplicity of purposes as another furniture article. The versatility of the invention allows for a varied combination of materials in manufacturing this article of furniture. For example, glass can be used for the movable top of the furniture, while iron or wood can be used for the base.

DESCRIPTION OF THE PREFERRED EMBODIMENT

Figure 1:
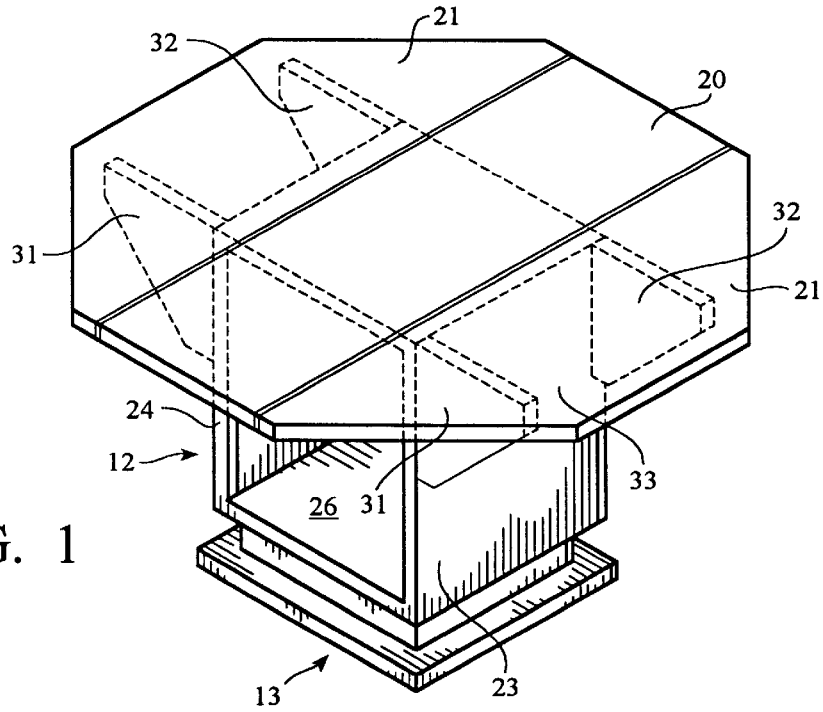
FIG. 1 is a perspective view of the convertible furniture article of the present invention in a table configuration.
Figure 2:
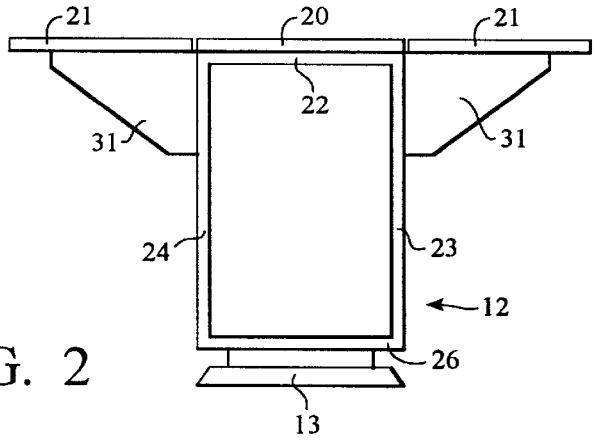
FIG. 2 is a frontal view of the furniture article shown in FIG. 1.
Figure 3:
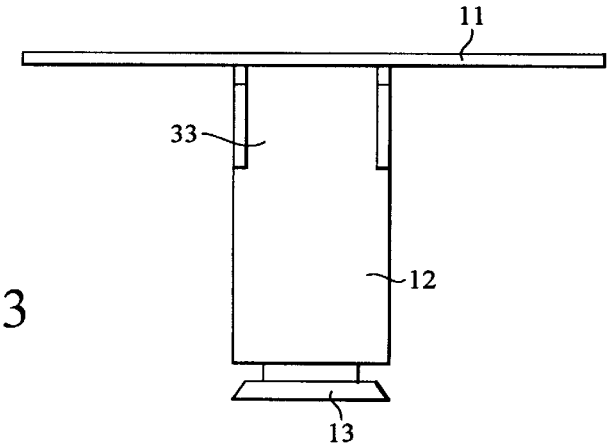
FIG. 3 is a side view of the furniture article shown in FIG. 1.

With reference to FIGS. 1–3, the table configuration of the present invention features a top 11, a base 12, an optional pedestal or stand 13. The parts are preferably made out of wood, but could be made of other durable materials, such as particle board or plastic. The top may be seen to be polygonal, namely octagonal, preferred for card games, but other shapes, such as hexagonal or round, could also be used. The base is seen to have a rectangular cross-section. For stability, a square cross-section is best, although not shown.

Top 11 has three hingedly connected sections: a rectangular center panel 20, and two trapezoidal side leaves 21. The side leaves join the center panel along parallel, spaced apart joinder lines. The base 12 may be hingedly or otherwise connected to the center panel 20 and is of equal width as the center panel 20. The base 12 has a planar top 22, seen in FIG. 2, connected to center panel 20, and having two solid side walls 23, 24, a solid back wall 25, and an open front. The stand 13 supports base 12 and is attached to the bottom wall 26 of base 12.

The side support structures, best seen in FIG. 1, each consists of three pieces of thin boards: the two trapezoidal side boards 31 and 32, and a rectangular connecting board 33 which joins side boards 31 and 32. The position of the side support structures in relation to side walls 23 and 24 of base 12 and top 11 is more clearly seen in FIG. 2 and FIG. 3, which provide side views of this convertible piece of furniture.

When the furniture is used as a table, the two side leaves 21 of the top 11 are propped up in a horizontal position by the two side support structures, including side boards 31 and 32, plus connecting board 33. The connecting boards 33 of side support structures are of the same width as the side walls 23 and 24 and rest against the side walls 23 and 24 of the base 12 when the top 11 is in horizontal position. The side support structures 14 are mounted below the side leaves 21 by mounting brackets.

Figure 4:
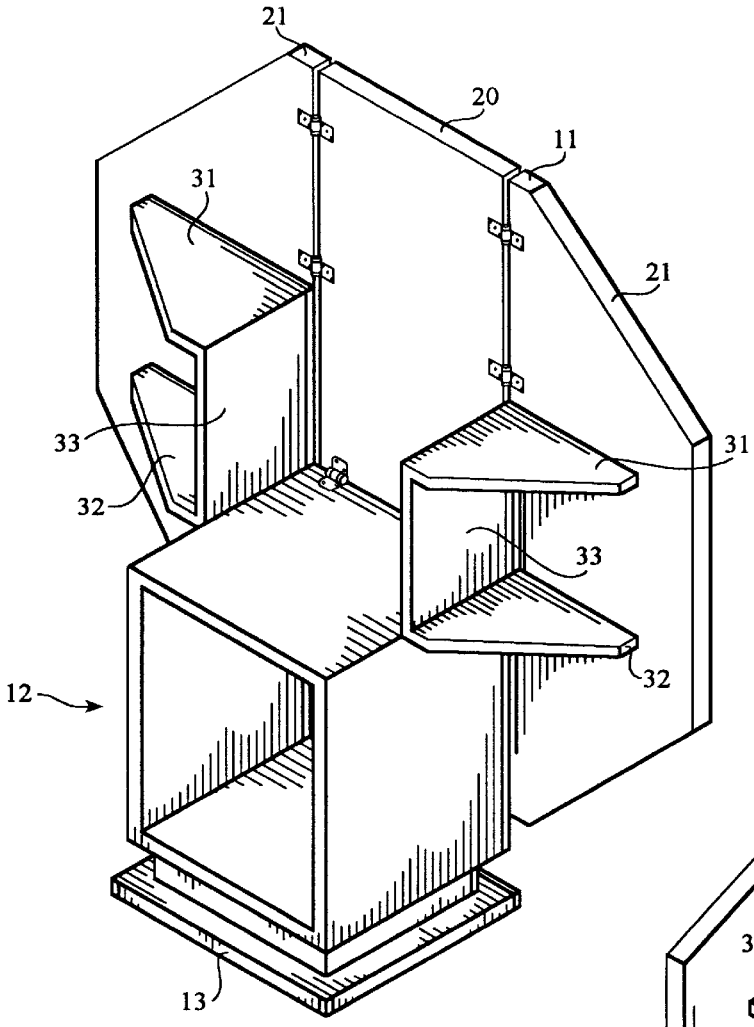
FIG. 4 is a perspective view of the furniture article of FIG. 1 in a first display configuration.
Figure 5:
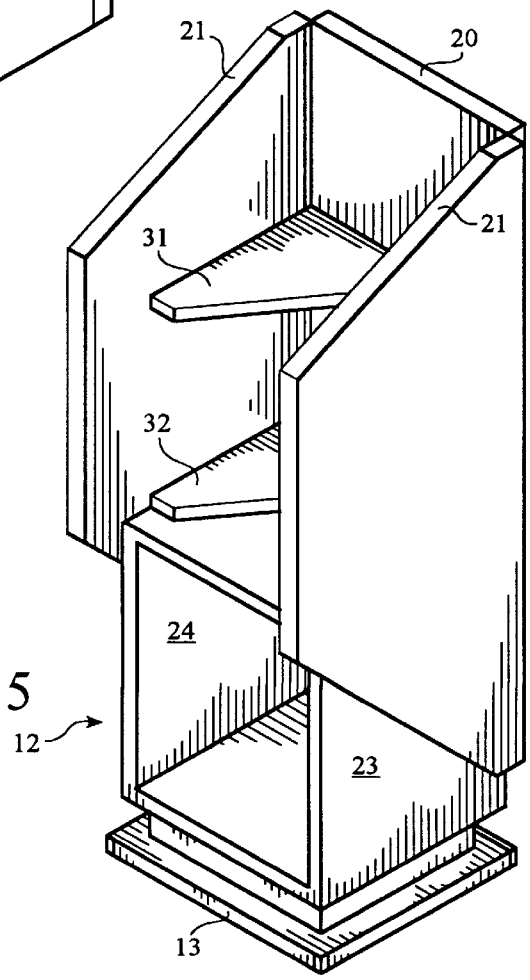
FIG. 5 is a perspective view of the furniture article of FIG. 1 in a second display configuration.

FIG. 4 and FIG. 5 show the table of FIGS. 1–3 converted to a display article of furniture. The top 11 pivots to be in a vertical position and stands behind the back wall of the base 12. In the preferred embodiment, the size of the top is such that it clears the floor in the vertical position upon pivoting vertically. The side boards 31 and 32 of the side support structure in FIG. 4 serve as display shelves, perhaps for decorative items. On the other hand, the side leaves 21 of the top 11 can be folded inward, as shown in FIG. 5, so the side leaves 21 of top 11 are parallel to the side walls 23 and 24 of the base 12. Temporary clips or brackets, not shown, keep the side leaves in the desired position. In this embodiment, the side boards 31 and 32 become book shelves. Many uses can be found for the vertically positioned top, such as an entertainment center, with tapes, CDs, or speakers which can be placed on side boards 31 and 32. Alternatively the unit may serve as a computer stand where reference manuals will be placed on shelves formed by side boards 31 and 32.

Figure 6:
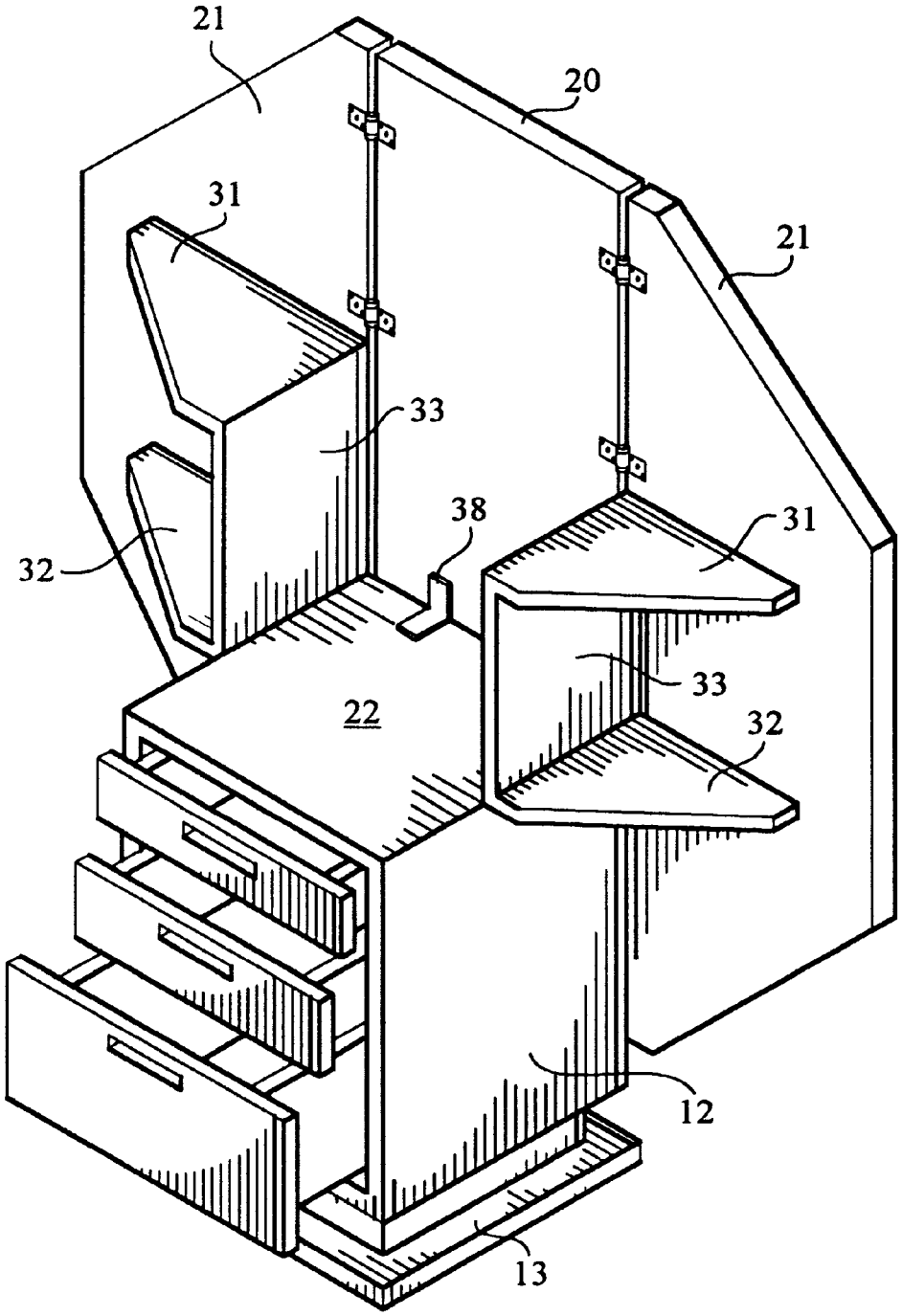
FIG. 6 is a perspective view of an alternative embodiment of the furniture article shown in FIG. 4.

FIG. 6 shows an alternative embodiment of the invention, but similar to FIG. 4, wherein drawers can be inserted into the interior of base 12 to increase storage space when top 11 is in a vertical position. While the base has at least three side walls, the interior volume of the base can be used for many purposes. Different inserts, such as wine racks, can be inserted into the interior of base 12 depending on the desired function. Note that in FIG. 6, the top is not hingedly connected to the base, but employs clips, such as clip 38, which grasps upper and lower surfaces of planar top 22. Other fasteners may also be used, but the top and base are intended to be a single unit of convertible furniture in different configurations.

What is claimed is:

1. A convertible article of furniture comprising:

a box shaped base having a planar top and upright, spaced apart side walls, and a flat top having overall dimensions of a table top, the top being movably joined to the base in one of a first vertical orientation wherein the top stands behind the base, and a second horizontal orientation wherein the top is parallel to the planar top of the base and wherein said top consists of three hingedly connected sections including a center panel and two side leaves of equal size.

2. The article of furniture as claimed in claim 1 wherein two side support structures are mounted to an underside of said side leaves of said top.

3. A convertible article of furniture comprising:

a box shaped base frame with planar top and planar bottom, and a flat top having overall dimensions of a table top, the top being movably joined to the planar top of the base and supportable by the base in one of two orientations including a vertical orientation wherein the top stands behind the base, and a horizontal orientation wherein said top is parallel to the planar top of the base and wherein said top consists of three hingedly connected sections, including a center panel and two side leaves.

4. The article of furniture as claimed in claim 3 wherein two side support structures are mounted to an underside of said side leaves of said top.

* * * * *